US010251520B2

(12) United States Patent
Jeong et al.

(10) Patent No.: US 10,251,520 B2
(45) Date of Patent: Apr. 9, 2019

(54) SUCTION NOZZLE APPARATUS AND CLEANER HAVING THE SAME

(71) Applicant: Samsung Electronics Co., Ltd., Suwon-si (KR)

(72) Inventors: Kyung-han Jeong, Suwon-si (KR); Young-sung Jung, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 64 days.

(21) Appl. No.: 15/467,144

(22) Filed: Mar. 23, 2017

(65) Prior Publication Data

US 2017/0280957 A1 Oct. 5, 2017

(30) Foreign Application Priority Data

Mar. 29, 2016 (KR) ..... 10-2016-0037629

(51) Int. Cl.

| | |
|---|---|
| ***A47L 9/04*** | (2006.01) |
| ***A47L 7/00*** | (2006.01) |
| ***A47L 9/16*** | (2006.01) |
| ***A47L 9/00*** | (2006.01) |
| ***A47L 5/36*** | (2006.01) |
| ***A47L 5/30*** | (2006.01) |

(52) U.S. Cl.

CPC ..... *A47L 9/0488* (2013.01); *A47L 5/30* (2013.01); *A47L 5/362* (2013.01); *A47L 7/0066* (2013.01); *A47L 9/009* (2013.01); *A47L 9/0411* (2013.01); *A47L 9/0477* (2013.01); *A47L 9/1683* (2013.01)

(58) Field of Classification Search

CPC ..... A47L 9/0488; A47L 5/30; A47L 5/362; A47L 7/0066; A47L 9/009; A47L 9/0411; A47L 9/0477; A47L 9/1683

See application file for complete search history.

(56) References Cited

U.S. PATENT DOCUMENTS

| | | | | |
|---|---|---|---|---|
| 4,802,254 | A * | 2/1989 | Lahndorff | A47L 9/04 15/179 |
| 8,087,117 | B2 | 1/2012 | Kapoor et al. | |
| 8,601,643 | B2 | 12/2013 | Eriksson | |
| 9,314,140 | B2 * | 4/2016 | Eriksson | A47L 9/0477 |
| 9,775,477 | B2 * | 10/2017 | Eriksson | A47L 9/0411 |
| 9,820,626 | B2 * | 11/2017 | Eriksson | A46B 13/006 |
| 2009/0229075 | A1 * | 9/2009 | Eriksson | A46B 13/006 15/383 |
| 2014/0143978 | A1 | 5/2014 | Li et al. | |
| 2018/0070785 | A1 * | 3/2018 | Udy | A47L 7/0066 |

FOREIGN PATENT DOCUMENTS

| | | |
|---|---|---|
| JP | 5-95868 | 4/1993 |

* cited by examiner

*Primary Examiner* — Dung Van Nguyen
(74) *Attorney, Agent, or Firm* — Staas & Halsey LLP

(57) ABSTRACT

A suction nozzle apparatus and a cleaner having the same includes a casing of which a mounting groove is formed in a bottom surface, a drum brush rotatably coupled to the mounting groove of the casing, and a cutting member configured to remove a foreign substance wound around the drum brush. The drum brush includes a drum core in which at least one foreign substance collecting groove that the foreign substance is wound is formed in an outer circumference and a blade formed in a spiral form in the outer circumference of the drum core.

19 Claims, 14 Drawing Sheets

SUCTION NOZZLE APPARATUS AND CLEANER HAVING THE SAME

CROSS-REFERENCE TO RELATED APPLICATIONS

This application claims priority from Korean Patent Application No. 10-2016-0037629, filed on Mar. 29, 2016, in the Korean Intellectual Property Office, the disclosure of which is incorporated herein by reference in its entirety.

BACKGROUND

1. Field

Apparatuses and methods consistent with exemplary embodiments relate to a suction nozzle apparatus and a cleaner having the same, and more particularly, to a suction nozzle apparatus capable of removing foreign substances caught in a drum brush and a cleaner having the same.

2. Description of the Related Art

Vacuum cleaners used for convenience of living have become inevitable daily necessity. An area of which foreign substances are attached to a deep inside, for example, such as carpet may be cleaned through such vacuum cleaners. It is difficult to suck the foreign substances attached to the deep inside between piles of the carpet only by simply moving the suction port of the vacuum cleaner to a carpet surface.

Accordingly, drum brushes have been employed in the vacuum cleaners. While the drum brushes rotate, the drum brushes may strike objects of which the foreign substances are attached to the deep inside, for example, carpet and separate the foreign substances from the carpet. The vacuum cleaner may remove the separated foreign substances by sucking the separated foreign substances through suction force.

However, in the drum brushes which have a blade configured of a plurality of piles in outer circumferences of the drum brushes or a blade in which a certain groove is formed, foreign substances may be caught between the piles of the blade or in the groove of the blade and thus may hinder smooth operations of the drum brushes. In response to long foreign substances such as hairs being wound around the blade of the drum brush, the foreign substances may be cumulatively wound and thus the load on the rotation of the drum brush may be increased. Accordingly, it is impossible for the drum brush to operate and it may be difficult for the cleaner to clean a surface to be cleaned such as carpet.

Therefore, there is a dramatic need for developing a new drum brush which foreign substances are not well caught therein and ensures a smooth operation of the drum brush by appropriately removing the caught foreign substances from the drum brush.

SUMMARY

Exemplary embodiments may overcome the above disadvantages and other disadvantages not described above. Also, an exemplary embodiment is not required to overcome the disadvantages described above, and an exemplary embodiment may not overcome any of the problems described above.

One or more exemplary embodiments relate to a suction nozzle apparatus which includes a drum brush having a structure that foreign substances are not well caught and a cleaner having the same.

One or more exemplary embodiments relate to a suction nozzle apparatus which ensures a smooth operation of a drum brush by appropriately detaching foreign substances caught in the drum brush from the drum brush and a cleaner having the same.

According to an aspect of an exemplary embodiment, there is provided a suction nozzle apparatus including a casing of which a mounting groove is formed in a bottom surface; a drum brush rotatably coupled to the mounting groove of the casing; and a cutting member configured to remove a foreign substance wound around the drum brush. The drum brush may include a drum core in which at least one foreign substance collecting groove that the foreign substance is wound is formed in an outer circumference and a blade formed in a spiral form in the outer circumference of the drum core.

According to an aspect of an exemplary embodiment, there is provided a cleaner including a main body including a suction source configured to provide suction force and a dust collector configured to collect a foreign substance; and a suction nozzle apparatus having a suction passage coupled to the main body in an inside. The suction nozzle apparatus may include a drum brush including at least one foreign substance collecting groove configured to collect the foreign substance and a plurality of rubber blades coupled in a spiral form to move the foreign substance to the foreign substance collecting groove; and a cutting member configured to remove the foreign substance wound around the foreign substance collecting groove through friction force or heat.

Additional aspects and advantages of the exemplary embodiments are set forth in the detailed description, and will be obvious from the detailed description, or may be learned by practicing the exemplary embodiments.

BRIEF DESCRIPTION OF THE DRAWINGS

The above and/or other aspects of the present invention will be more apparent by describing certain exemplary embodiments of the present invention with reference to the accompanying drawings, in which.

DETAILED DESCRIPTION

Figure 1:
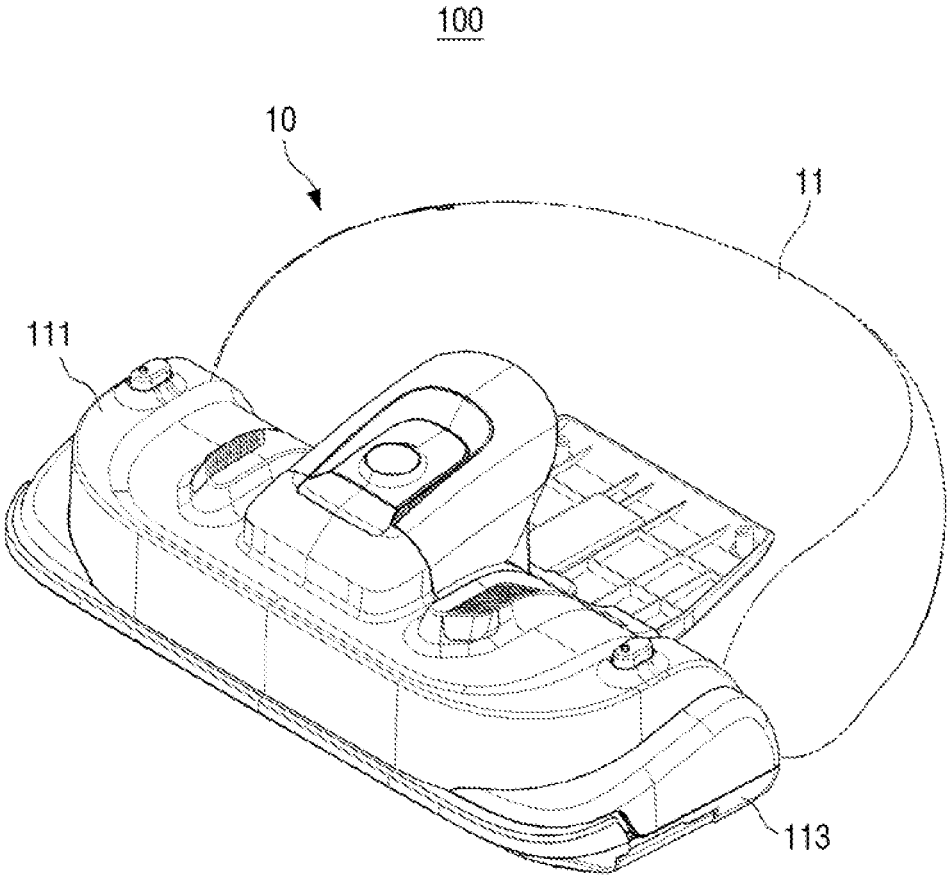
FIG. 1 is a plan perspective view illustrating a suction nozzle apparatus according to an exemplary embodiment.

Hereinafter, the exemplary embodiments are described in greater detail with reference to the accompanying drawings. The matters defined in the description, such as detailed construction and elements, are provided to assist in a comprehensive understanding of the exemplary embodiments. Thus, it is understood that the exemplary embodiments can be carried out without those specifically defined matters.

Various embodiments will now be described more fully with reference to the accompanying drawings in which some embodiments are shown. The techniques described herein are exemplary, and should not be construed as implying any particular limitation on the present disclosure. It should be understood that various alternatives, combinations and modifications could be devised by those skilled in the art. In the following description, unless otherwise described, the same reference numerals are used for the same elements when they are depicted in different drawings.

Hereinafter, the exemplary embodiments of a suction nozzle apparatus for a cleaner which overcomes catching of a foreign substance will be described in greater detail with reference to the accompanying drawings. Here, it has been described in the exemplary embodiments that the suction nozzle apparatus is applied to a robot cleaner to assist in a comprehensive understanding of the exemplary embodiments, but this is merely exemplary. Thus, it is understood that the exemplary embodiments can be variously modified as a canister vacuum cleaner, an upright vacuum cleaner, a stick vacuum cleaner, and the like and carried out differently from the exemplary embodiments described herein. However, in the following description, detailed description for the related functions or elements will be omitted when the gist of the inventive concept is unnecessarily obscure due to the detailed description for the related functions or elements.

Figure 2:
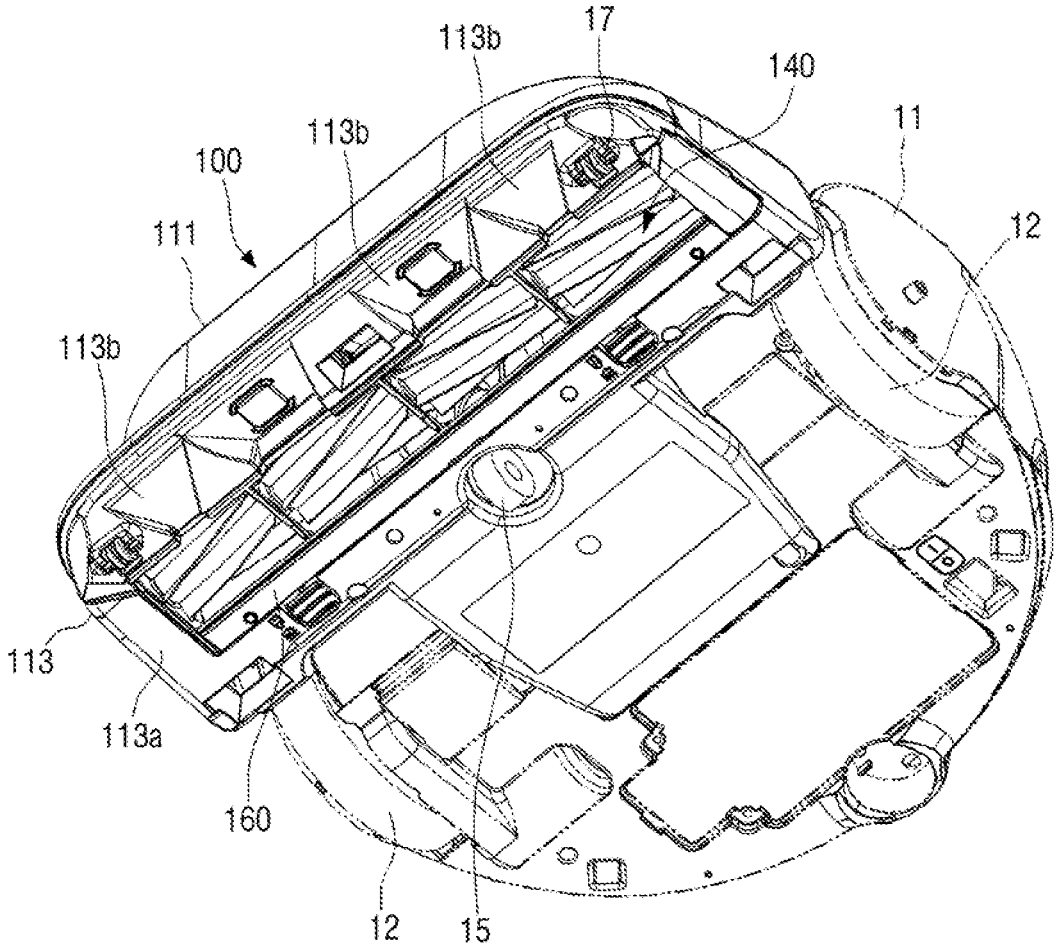
FIG. 2 is a bottom perspective view illustrating a suction nozzle apparatus according to an exemplary embodiment.
Figure 3:
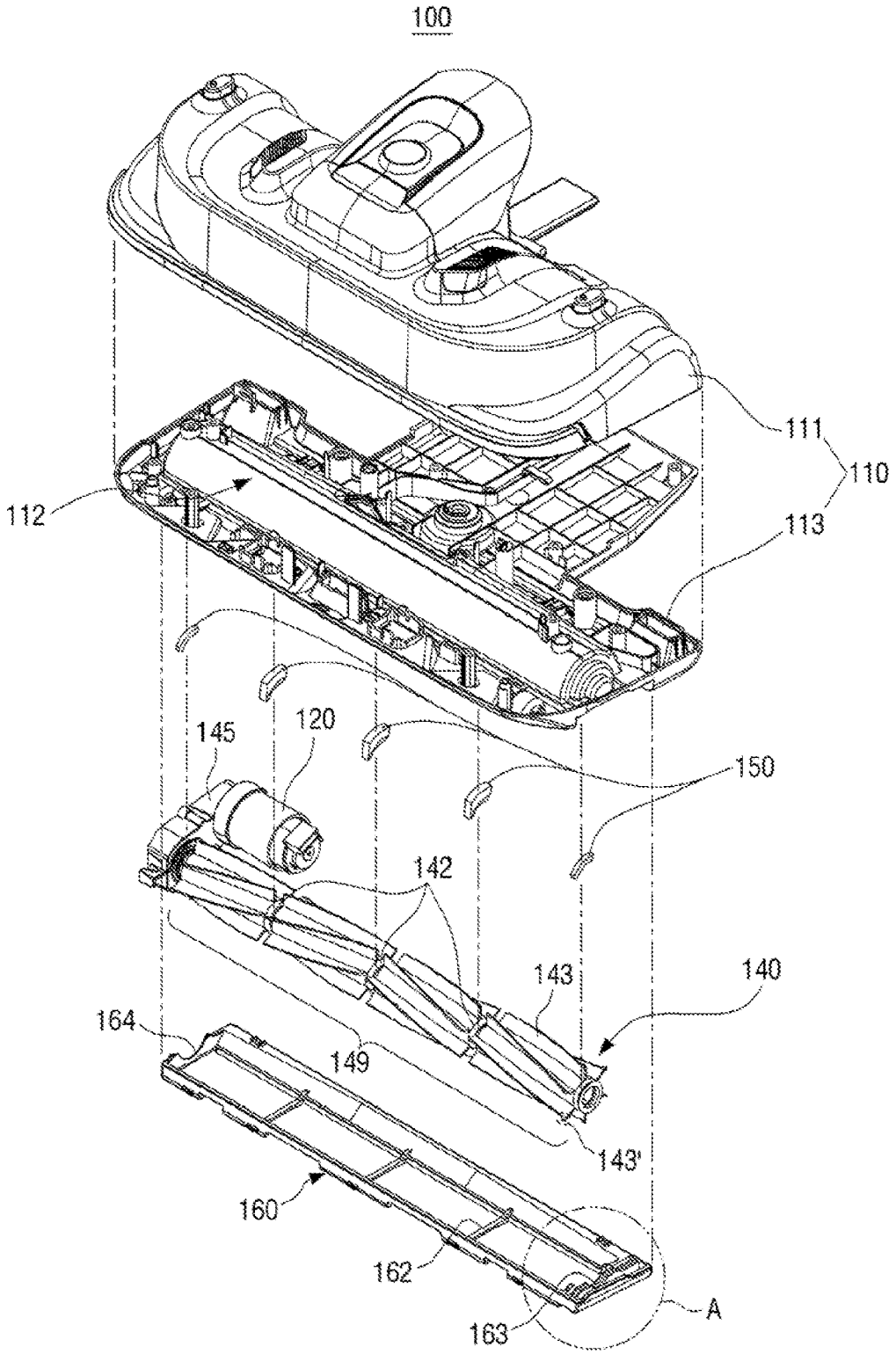
FIG. 3 is an exploded perspective view illustrating a suction nozzle apparatus according to an exemplary embodiment.
Figure 4:
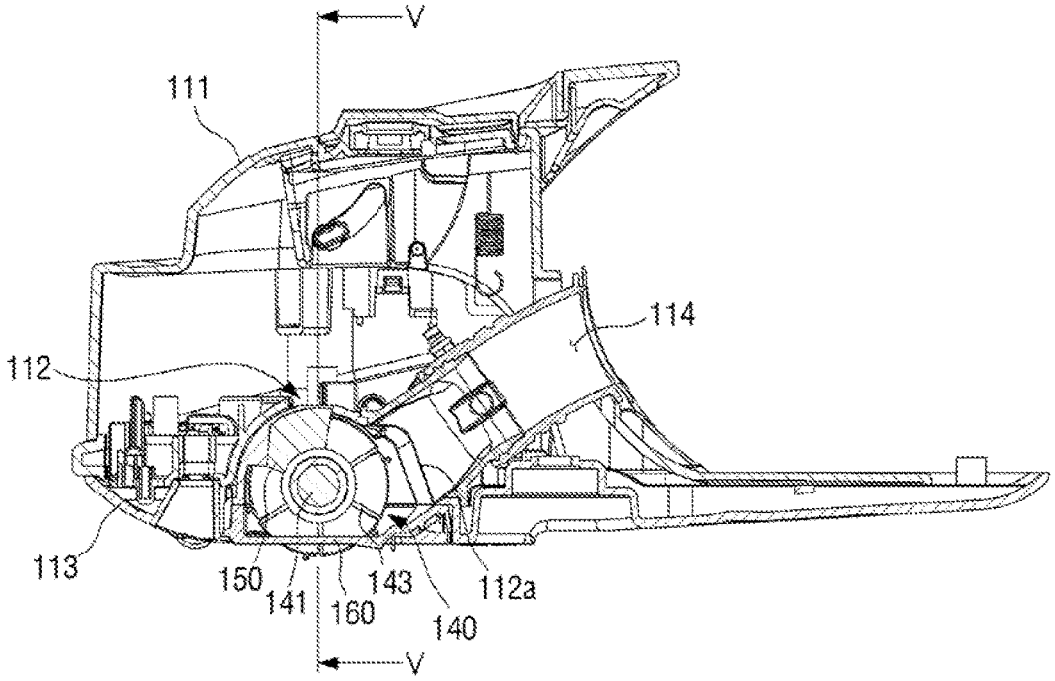
FIG. 4 is a side view illustrating a suction nozzle apparatus according to an exemplary embodiment.

FIGS. 1 to 3 are a plane perspective view, a bottom perspective view, and an exploded perspective view illustrating a suction nozzle apparatus according to an exemplary embodiment and FIG. 4 is a side view illustrating a suction nozzle apparatus according to an exemplary embodiment.

Referring to FIGS. 1 to 3, a suction nozzle apparatus 100 according to an exemplary embodiment may be installed in a main body 11 of a robot cleaner 10. Although not shown in FIGS. 1 to 3, the robot cleaner 10 may include a suction motor serving as a suction source and a dust collector in the inside of the main body 11. The suction motor may generate fixed suction force for sucking dirt on a surface to be cleaned and the dust collector may collect the dirt, which is sucked into the main body 11 through the suction nozzle apparatus 100, through the suction force. The dust collector may have a cyclone structure which separates the dirt from the sucked air using centrifugal force.

The main body 11 may include a pair of traveling wheels 12 and a driving motor (not shown) configured to drive the pair of traveling wheels 12. The robot cleaner 10 may include a first idle wheel 15 and a pair of second idle wheels 17 provided in a lower portion of a lower casing 113 to be described later in addition to the traveling wheels 12. The first idle 15 may be disposed in a rear center of the lower casing 113 and the pair of second idle wheels 17 may be disposed at both front sides of the lower casing 113.

Referring to FIG. 3, the suction nozzle apparatus 100 may include a casing 110 and a driving unit 120, a drum brush (see 140 of FIG. 4), a cutting member, and a base brush 160 disposed in the inside of the casing 110.

For the convenience of manufacture, an upper casing 111 and the lower casing 113 may be separately manufactured and assembled to the casing 110. However, this is not limited thereto and the upper casing 111 and the lower casing 113 may be manufactured in a single member.

A mounting groove (see 112 of FIG. 3) on which the drum brush 140 may be rotatably mounted may be formed in a portion of the lower casing 113 which is directed to a floor. The mounting groove 112 may have an elevated structure (see FIG. 3) to a fixed height to surround the drum brush 140 so that an upper portion of the mounting groove 112 may substantially correspond to a shape of the drum brush 140.

Referring to FIG. 4, a suction port 112*a* which communicates with a suction passage 114 may be formed in the inner rear of the mounting groove 112. The suction port 112*a* may couple the mounting groove 112 to the suction passage 114 and in response to negative pressure being formed on the suction passage 114, the negative pressure may also be formed in the mounting groove 112 and the suction port 112*a* may suck a foreign substance on the surface to be cleaned.

Referring back to FIG. 2, a plurality of suction grooves 113*b* may be formed in the lower casing 113 along a front bottom surface 113*a* of the lower casing 113 so that a foreign substance may be sucked into the mounting groove 112. In response to the lower casing 113 being placed on the surface to be cleaned such as a wooden floor, a fixed space may be formed between the bottom surface 113*a* of the lower casing 113 and the surface to be cleaned by the pair of second idle wheels 17. Accordingly, the foreign substance on the surface to be cleaned may be sucked to the mounting groove 112 through the plurality of suction grooves 113*b* and the space between the bottom surface 113*a* of the lower casing 113 and the surface to be cleaned.

The driving unit 120 may be a driving source configured to rotatably drive the drum brush 140 and may be disposed in the inside of the casing 110. The driving unit 120 may be configured of a motor and may provide power for rotating the drum brush 140 by transferring rotation force to the drum brush 140 through a coupler 145 to be described later.

In response to the negative pressure being formed in the suction passage through the suction motor, the robot cleaner 10 may suck a foreign substance (for example, dust, dirt, and the like) on the surface to be cleaned by inducing air flow due to a pressure difference between the mounting groove 112 and an outer periphery of the mounting groove 112. In general, in response to the foreign substance being attached to a material such as carpet (not shown), it is difficult to suck the foreign substance attached to the deep inside of the carpet only through the air suction. Accordingly, the drum brush 140 may brush the foreign substance attached in the deep inside between a plurality of piles of the carpet to be scattered over the carpet and the scattered foreign substance may be sucked into the suction port 112*a* in the inside of the mounting groove 112.

Figure 5:
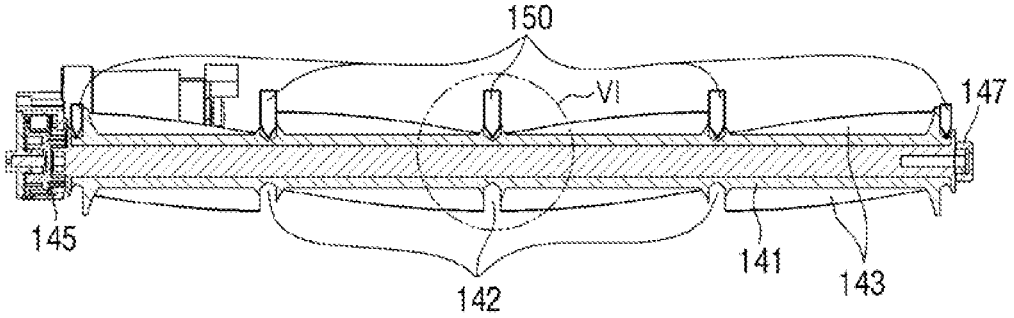
FIG. 5 is a cross-sectional diagram illustrating a drum brush taken along line V-V of FIG. 4.
Figure 6:
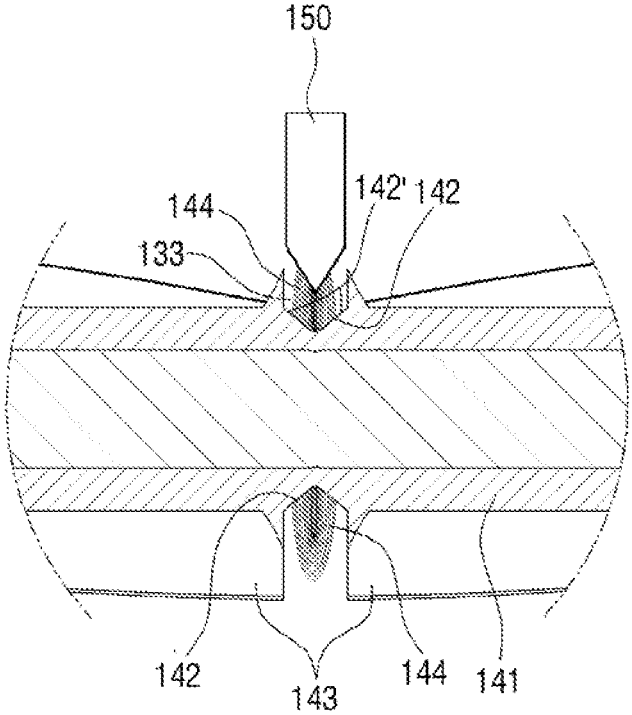
FIG. 6 is an enlarged view illustrating a portion VI of a grinder illustrated in FIG. 5.
Figure 7:
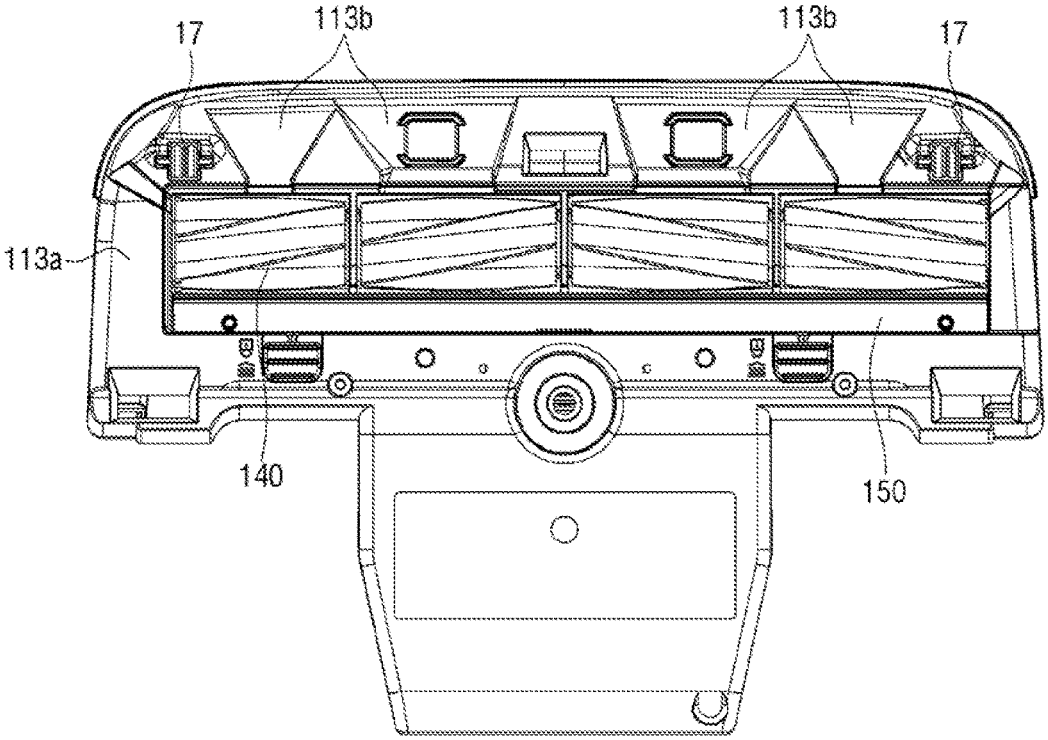
FIG. 7 is a bottom view illustrating a suction nozzle apparatus according to an exemplary embodiment.

FIG. 5 is a cross-sectional diagram illustrating the suction nozzle apparatus taken along line V-V of FIG. 4 and FIG. 6 is a partially enlarged view illustrating a portion VI of a grinder illustrated in FIG. 5.

Referring to FIG. 5, the drum brush 140 may include a drum core 141, a plurality of rubber blades 143 coupled to an outer circumference of the drum core 141 in a spiral direction, the coupler 145, and a bearing 147.

The drum core 141 may form a rotational center shaft of the drum brush 140 and support the rubber blades 143. For example, a plurality of foreign substance collecting grooves 142 may be formed in the outer circumference of the drum core 141 at a fixed interval. In this example, the plurality of foreign substance collecting grooves 142 may be formed along a circumferential direction of the drum brush 140.

Cutting members may be disposed to correspond to the plurality of foreign substance collecting grooves 142 and gaps (see 133 of FIG. 6) in which a foreign substance (for example, hair, animal fur, and the like) is piled may be formed between the plurality of foreign substance collecting grooves 142 and the cutting members.

A foreign substance (for example, hair and the like), which rotates together with the drum brush 140, may be wound around the plurality of rubber blades 143 and simultaneously may gradually move toward the gaps 133 formed in the drum brush 140 and the foreign substance may be wound around the plurality of foreign substance collecting grooves 142 and piled in the gaps 133.

Referring to FIG. 6, the plurality of foreign substance collecting grooves 142 may have inclined surfaces 142' which are formed to be gradually narrowed from the outer sides thereof to the inner sides thereof. The inclined surfaces 142' may guide hair 144 to be wound around the plurality of foreign substance collecting grooves 142 from the centers of the foreign substance collecting grooves 142. In response to the hair 144 being wound around the foreign substance collecting grooves 142, friction force may be generated between the foreign substance collecting grooves of the drum core and the hair 144. The hair 144 may not run idle due to the friction force and may be wound around the drum core. Accordingly, a material for the foreign substance collecting groove in the drum core may be selected, for example, from a material for generating the friction force sufficient to support the hair so that the hair may not run idle in the foreign substance collecting groove in the drum core and may smoothly wound around the foreign substance collecting groove.

The number of the plurality of foreign substance collecting grooves 142, depths of the plurality of foreign substance collecting grooves 142, the number of gaps 133, and the interval between the gaps 133 may be variously changed on the design.

The rubber blade 143 may function to strike a cleaning object of which a foreign substance is attached to a deep inside, for example, carpet and scatter the foreign substance. The number of rubber blades 143 may be variously modified within a range of the detailed design.

The rubber blade 143 may be formed in a sheet form in which a groove is not formed. In response to the groove being formed in the rubber blade 143, a foreign substance such as hair may be wound around the rubber blade 143 and thus the hair may be caught in the groove. Accordingly, the hair cumulatively wound around the groove may hinder the rotation of the drum brush 140 and thus may disable the operation of the drum brush 140. To overcome the disadvantage of the drum brush 140, the drum brush 140 in the exemplary embodiment may have the structure that a foreign substance is not be caught by forming the rubber blade 143 in the sheet form in which the groove is not formed. The rubber blade 143 may be formed in a sheet form which is thin and has a relatively large area to effectively strike the structure such as carpet.

One end of the rubber blade 143 may be formed on a surface of the drum core 141 in a spiral form. Accordingly, a foreign substance such as hair may be wound around the rotating rubber blade 143 and simultaneously may move to a length direction of the drum core 141 through the rubber blade 143 formed in the spiral form. The moving foreign substance wound around the rubber blade 143 may reach the gap 133 formed between the drum core 141 and a tip of the cutting member to be wound around the plurality of foreign substance collecting grooves 142 and thus the foreign substance may be grinded and finely cut through the cutting member disposed to correspond to each foreign substance collecting groove 142.

The plurality of rubber blades may be configured of at least two groups disposed at both sides of the foreign substance collecting groove and the rubber blade groups may be formed to have opposite spiral directions to each other to move the foreign substance to the foreign substance collecting groove.

A method of coupling the rubber blade 143 to the drum core may be variously implemented. For example, the spiral foreign substance collecting groove may be formed in the outer circumference of the drum core and then the sheet-shaped rubber blade 143 may be inserted into and coupled to the spiral foreign substance collecting groove. In another example, the rubber blade 143 manufactured in the sheet form may be fixed to the outer circumference of the drum core through hot pressing. In another example, in response to the plurality of rubber blades 143 being formed in the drum core, a rubber blade assembly 149 may be manufactured for manufacturing efficiency. In this example, the rubber blade assembly may be manufactured through injection molding and then assembled by covering the rubber blade assembly on the outer circumference of the drum core along the length direction of the drum core. The coupler 145 may be coupled to one side of the drum core 141. The coupler 145 may transfer the rotation force of the driving unit 120 to the drum core 141.

The bearing 147 may be coupled to the other side of the drum core 141 and the drum core 141 may be rotatably supported through a supporting projection (not shown) protruding in the mounting groove 112.

The drum brush 140 may receive the rotation force through the driving unit 120. In response to a motor 121 being used as the driving unit 120, the motor 121 may accurately control speed and may be environmentally friendly.

Figure 10:
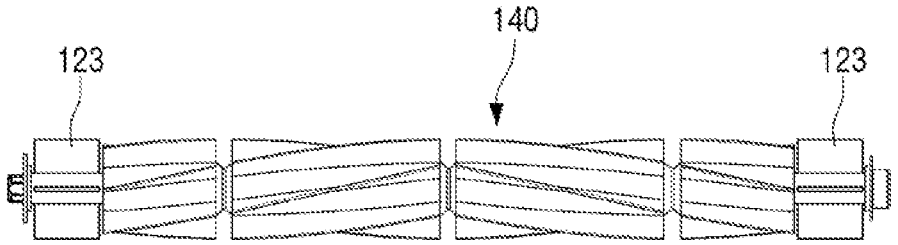
FIG. 10 is a cross-sectional diagram illustrating a drum brush on which a turbine is mounted according to another exemplary embodiment.

In response to a vacuum cleaner being used in an industrial field, the driving unit may receive high-pressure compressed air from an air compressor (not shown) and transfer the rotation force to the drum brush 140. FIG. 10 is a cross-sectional diagram illustrating the drum brush 140 on which a turbine 123 is mounted according to an exemplary embodiment. A small turbine 123 may be mounted on both ends of the drum brush 140. The high-pressure compressed air provided from the air compressor may be collided with wings of the turbine 123 and the turbine 123 may transfer the rotation force to the drum brush 140.

Figure 9:
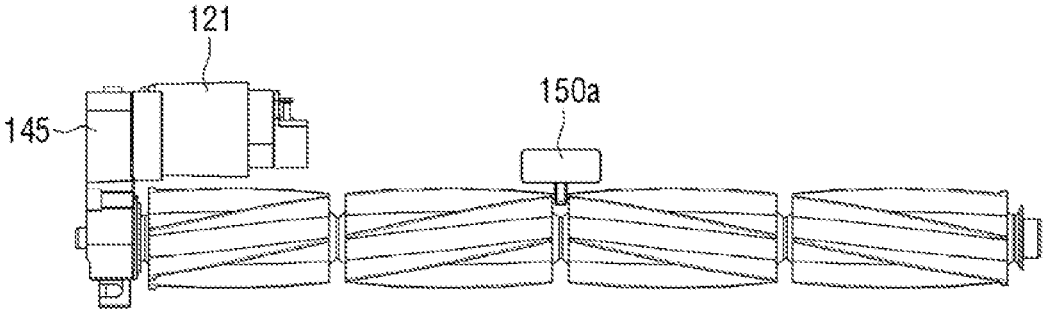
FIG. 9 is a cross-sectional diagram illustrating a drum brush on which a heater is mounted according to another exemplary embodiment.

The motor 121 illustrated in FIG. 9 may be replaced with the small turbine 123 and the small turbine 123 may be mounted on a position in which the motor is installed. The rotation force of the small turbine 123 may be transferred to the drum brush 140 through a belt (not shown) mounted on the inside of the coupler.

The suction nozzle apparatus 100 for a vacuum cleaner according to the exemplary embodiment may provide a cutting member which cuts a foreign substance piled in the gap 133 of the drum brush 140. The foreign substance cut through the cutting member may sucked through the suction port 112*a* formed in one side of the casing 110. Accordingly, even in response to a foreign substance which hinders the rotation of the drum brush 140 such as long wool or hair being piled, the foreign substance may be cut through the cutting member and sucked into the suction port 112*a* and thus the drum brush 140 may smoothly operate. Accordingly, a foreign substance which is attached to a deep inside of a material such as carpet may also be cleaned.

One end of the rubber blade 143 according to the exemplary embodiment may be formed on the surface of the drum core in a spiral form. While the robber blade 143 formed on the surface of the drum core in the spiral form rotates, a foreign substance such as hair may be wound around the drum core and simultaneously may be moved to a length direction of the drum core. Accordingly, the foreign substance wound around the drum core may reach the gap 133 formed in the drum core and may be cut through the cutting member formed near the gap 133.

Figure 8:
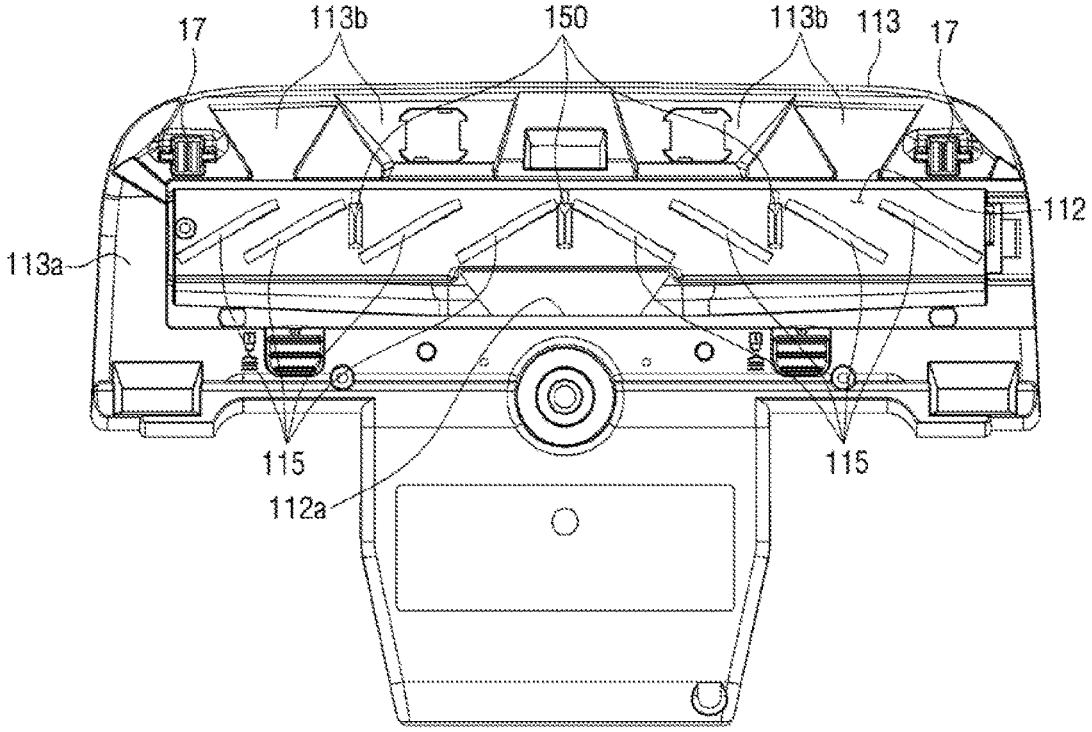
FIG. 8 is a bottom view illustrating a casing in which a drum brush is removed in FIG. 7.

To effectively move the foreign substance wound around the rubber blade 143 to the gap 133 formed in the drum core, a projection 115 may be formed in a spiral direction in a surface of the lower casing 113 surrounding the drum brush 140. The formed projection 115 may function to support the rubber blade 143 and guide the rubber blade 143 to the gap 133 formed in the drum core. FIG. 8 is a bottom view illustrating a lower casing according to an exemplary embodiment. The projection 115 formed in the spiral direction is illustrated in FIG. 8.

Various members as the cutting member configured to cut a foreign substance piled in the gap 133 may be implemented, but a cutting method through grinding and heating may be employed in the exemplary embodiment.

A grinder 150 may be formed to cut a foreign substance through grinding. The grinder 150 may be formed in the surface of the lower casing 113 surrounding the drum brush 140, for example, in a position of the surface which faces the gap 133.

The grinder 150 may be formed of a grind stone, may be formed by performing coating treatment only on a surface, or may be formed by forming a grinding joint on a surface through a rolling process.

Referring to FIGS. 3 and 5, three grinders 150 may be disposed in the center of the drum core 141 and two grinders 150 may be disposed in both ends of the drum core 141. For example, the two grinders 150 disposed in the both ends of the drum core 141 may cut a foreign substance flowing into both sides of the drum brush 140.

Referring to FIG. 6, the gap 133 in which a foreign substance is piled may be formed by the rubber blades 143 at the both sides of the gap 133 and the foreign substance collecting groove 142 formed on the drum core. A space may be formed between the grinder 150 formed in a position of the surface of the lower casing 113 which faces the gap 133 and the foreign substance collecting groove formed on the drum core 141. A foreign substance such as hair may be cumulatively piled in the space and the foreign substance may be cut by friction with a surface of the grinder 150 in response to the piled foreign substance being more than a fixed amount.

In response to the space being formed to be significantly narrowed, the interference may be caused due to vibration of the grinder 150 and the drum core 141. Accordingly, the space may be formed in a range of 1.5 mm or more.

FIG. 6 is a partially enlarged diagram illustrating a grinder according to an exemplary embodiment. Referring to FIG. 6, the grinder 150 may be formed to have a "V"-shaped cross section. The space between the grinder 150 and the foreign substance collecting groove 142 formed on the drum core may be narrowed toward the center of the foreign substance collecting groove. The foreign substance collecting groove 142 of the drum core may have a concave shape in the center thereof and in response to hair being wound around the foreign substance collecting groove 142 of the drum core, the hair may be collected and piled in the center of the foreign substance collecting groove 142. Since the space has the narrowest structure in the center of the foreign substance collecting groove 142, the hair wound around the foreign substance collecting groove 142 may be caught in and fixed to the center of the foreign substance collecting groove and then may be cut by friction with the grinder 150 in response to the piled hair being more than the space formed in the center of the foreign substance collecting groove.

FIG. 9 is a cross-sectional diagram illustrating the drum brush 140 on which a heater 150*a* is mounted according to an exemplary embodiment. The heater 150*a* may be employed as the cutting member and a foreign substance may be cut through heat. Referring to FIG. 9, the heater 150*a* may be formed in the surface of the casing 110 surrounding the gap 133. A foreign substance may be cumulatively piled between the heater 150*a* and the foreign substance collecting groove 142 formed on the drum core and the foreign substance may be in contact with the heated heater 150*a* and then cut in response to the piled foreign substance being more than a fixed amount.

Appropriate control may be necessary to use the heater 150*a* as the cutting member. For example, the time that current flows in the heater 150*a* to cut a foreign substance may be controlled. In another example, an overheating detecting sensor configured to prevent fire due to overheating may be mounted on the heater and power may be controlled to be shut off in response to the overheating being detected.

Figure 11:
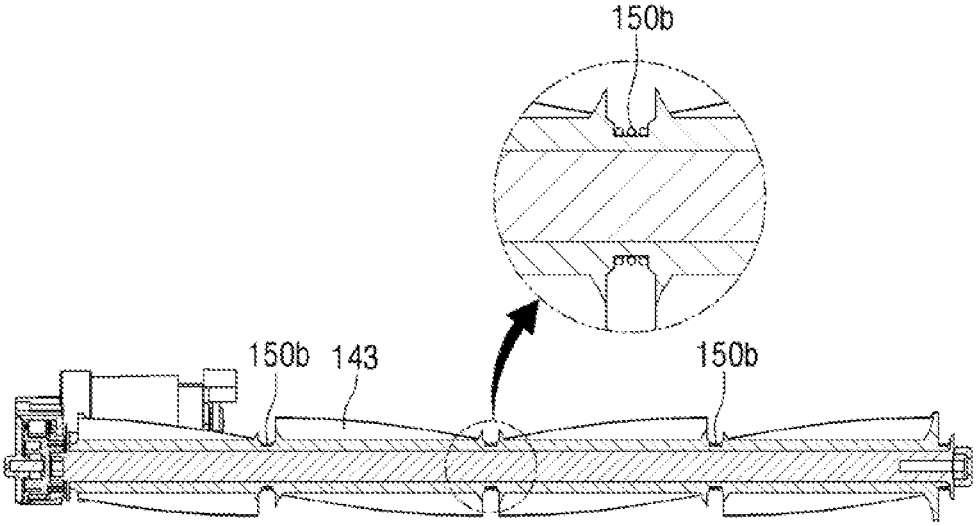
FIG. 11 is a cross-sectional diagram illustrating a drum brush on which a ring-shaped hot-wire coil is mounted according to another exemplary embodiment.

FIG. 11 is a diagram illustrating a drum core on which a ring-shaped hot-wire coil 150*b* is mounted according to an exemplary embodiment. Referring to FIG. 11, the ring-shaped hot-wire coil 150*b* as the cutting member may be mounted on the foreign substance collecting groove formed on the drum core. Ring-shaped grooves may be formed in the foreign substance collecting groove formed on the drum core and the ring-shaped hot-wire coil 150*b* may be mounted on each ring-shaped groove. The foreign substance may be cut through the current flowing through the ring-shaped hot-wire coil 150*b*.

FIG. 3 illustrates an example of a base brush according to an exemplary embodiment. Referring to FIG. 3, the suction nozzle apparatus 100 according to the exemplary embodiment may further include a base brush 160 which covers a lower portion of the drum brush 140. The base brush may include a rib 162 configured to prevent lead-in of a wiring scattered on the floor in cleaning, a hole 164 coupled to the drum core, and a grinder inserting unit 163.

As described above, the grinder 150 may be formed, for example, on the surface of the lower casing 113. In another example, the grinder 150 may also be formed in an edge portion of the base brush to effectively cut a foreign substance near the edge portion of the base brush 160. In this example, the grinder inserting unit 163 into which the grinder 150 is inserted may be formed in the edge portion of the base brush and the grinder 150 may be installed in the grinder inserting unit 163.

Figure 12:
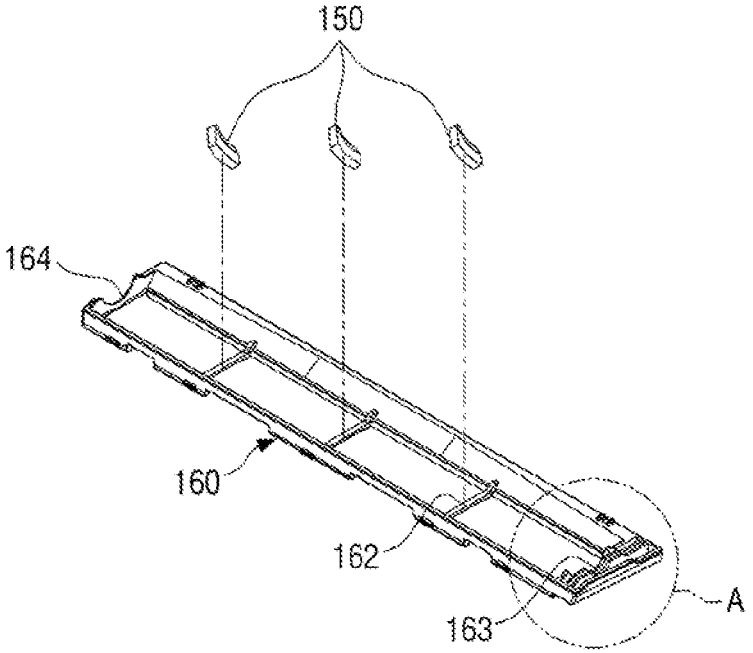
FIG. 12 is a diagram illustrating a base brush in which a grinder is installed on a rib according to another exemplary embodiment.

FIG. 12 is a diagram illustrating another example of a base brush of which the grinder is installed in the rib 162 according to an exemplary embodiment. The grinder may be installed in the rib configured to prevent lead-in of a wiring to effectively cut a foreign substance caught in the foreign substance collecting groove of the drum core.

Figure 13:
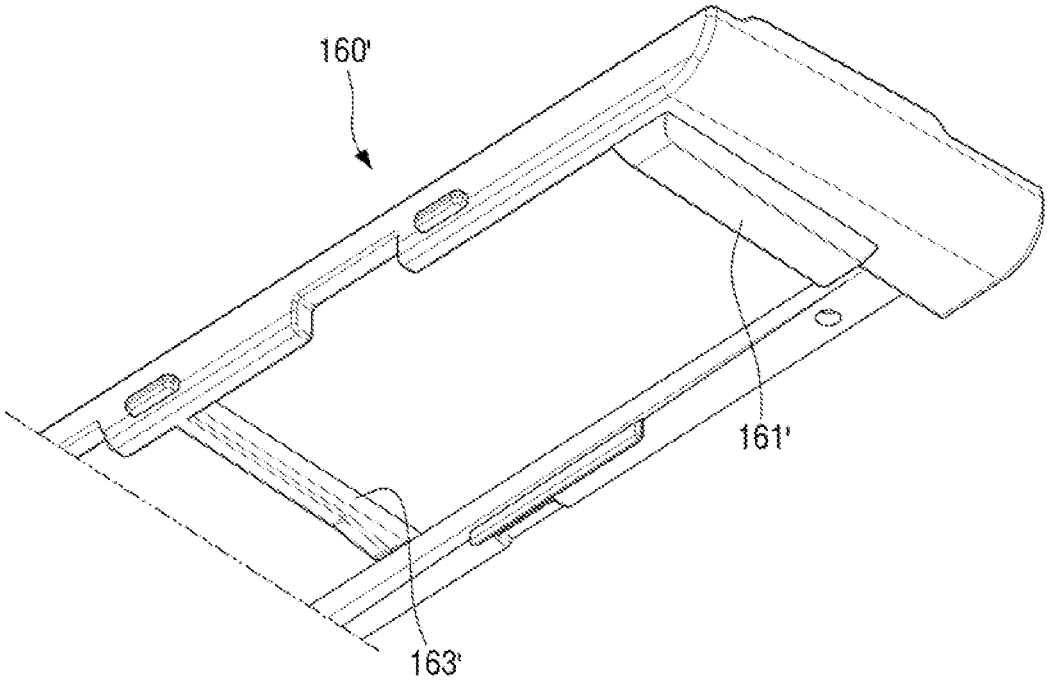
FIGS. 13 and 14 are partially enlarged perspective views illustrating a lower portion and an upper portion of a base brush illustrated in FIG. 3 according to another exemplary embodiment.
Figure 14:
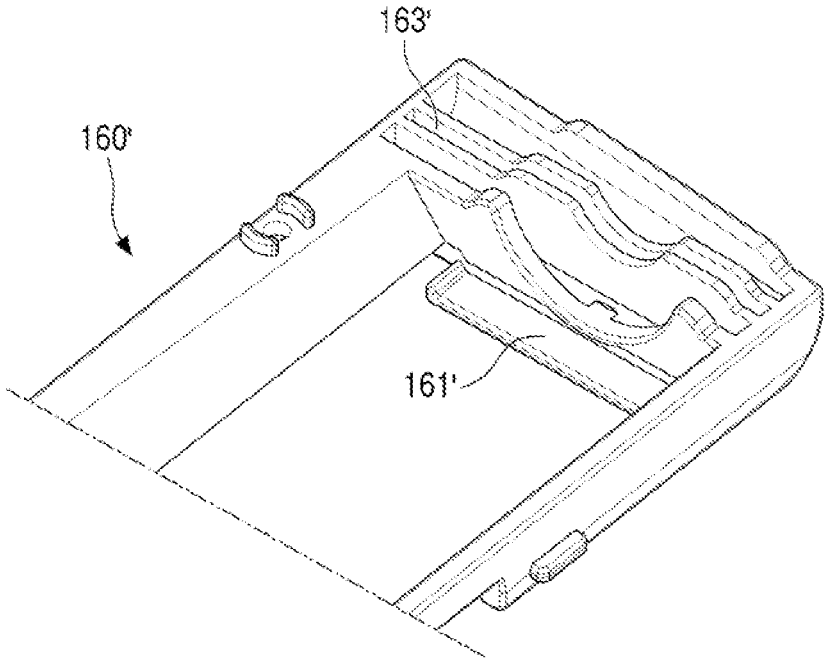

FIG. 13 is a partially enlarged diagram illustrating an A portion of the base brush in FIG. 3 and illustrates another example of a base brush including a side cover 161'. FIG. 14 is a partially enlarged diagram illustrating the A portion of the base brush in FIG. 3 and illustrates a grinder inserting unit 163'.

Referring to FIGS. 13 and 14, the side cover 161' elongated along a length direction of the base brush may be formed in an edge portion of the base brush. In response to the side cover being not formed in the edge portion of the base brush, a foreign substance such as hair may ride over walls at both ends of the base brush and may be caught in a fastening unit of the base brush. The side cover 161' may be formed in the base brush to be elongated along the length direction of the base brush to prevent the catching of the foreign substance near the edge portion of the base brush 160. In response to the base brush being coupled to the drum brush, a tip portion (see 143' of FIG. 3) of the rubber blade coupled to the drum brush may be pressed through the side cover 161' of the base brush which is in contact with the tip portion to effectively block a foreign substance flowing through both edge portions of the drum brush.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A suction nozzle apparatus comprising:

a casing having a bottom surface including a mounting groove;

a drum brush rotatably coupled to the mounting groove of the casing; and a cutting member configured to remove a foreign substance wound around the drum brush, wherein the drum brush includes a drum core having an outer circumference including a foreign substance collecting groove and a blade, and wherein the cutting member is fixed in a position corresponding to the foreign substance collecting groove.

2. The suction nozzle apparatus as claimed in claim 1, wherein the cutting member is disposed to form a gap with the foreign substance collecting groove.

3. The suction nozzle apparatus as claimed in claim 2, further comprising a plurality of blades, wherein the a plurality of blades comprise:

first and second blades group each disposed at both sides of the foreign substance collecting groove, and wherein the first and second blades group each from a spiral line in an opposite direction to move the foreign substance to the foreign substance collecting groove.

4. The suction nozzle apparatus as claimed in claim 2, wherein the cutting member is installed inside the mounting groove.

5. The suction nozzle apparatus as claimed in claim 2, wherein the cutting member includes a grinder configured to cut the foreign substance.

6. The suction nozzle apparatus as claimed in claim 5, wherein the foreign substance collecting groove is formed in a circumferential direction of the drum brush and has a structure which is gradually narrowed toward an inner side of the drum brush from an outer side of the drum brush.

7. The suction nozzle apparatus as claimed in claim 6, wherein a space between the grinder and the foreign substance collecting groove is narrowed toward a center of the foreign substance collecting groove.

8. The suction nozzle apparatus as claimed in claim 5, wherein the grinder comprising a grind stone, wherein the grind stone comprises a grinding joint formed on the surface of the grind stone, or wherein the grind stone is coated by a diamond on the surface of the grind stone.

9. The suction nozzle apparatus as claimed in claim 2, further comprising a base brush detachably installed in a lower portion of the casing and including at least one rib configured to prevent a wire from entering the mounting groove, and the cutting member is installed in the base brush.

10. The suction nozzle apparatus as claimed in claim 9, wherein the rib is formed in a position corresponding to the foreign substance collecting groove.

11. The suction nozzle apparatus as claimed in claim 2, further comprising a base brush detachably installed in a lower portion of the casing, and the base brush further includes at least one side cover configured to cover at least one of both end portions of the drum brush.

12. The suction nozzle apparatus as claimed in claim 1, wherein the cutting member includes a heating element.

13. The suction nozzle apparatus as claimed in claim 12, wherein the heating element forms a gap with the foreign substance collecting groove.

14. The suction nozzle apparatus as claimed in claim 12, wherein the heating element is wound around the foreign substance collecting groove.

15. The suction nozzle apparatus as claimed in claim 14, wherein the heating element includes a hot-wire coil.

16. A suction nozzle apparatus comprising:

a casing including an inner side having a suction passage, and a bottom surface including a mounting groove communicating with the suction passage;

a drum brush including a plurality of rubber blades rotatably installed in the mounting groove and a foreign substance collecting groove configured to collect a foreign substance; and a cutting member fixed in a position corresponding to the foreign substance collecting groove and configured to remove the foreign substance.

17. The suction nozzle apparatus as claimed in claim 16, wherein the cutting member maintains a space with the foreign substance collecting groove and cuts the foreign substance.

18. The suction nozzle apparatus as claimed in claim 16, wherein the cutting member burns the foreign substance.

19. A vacuum cleaner comprising:

a main body including a suction source configured to provide a suction force and a dust collector configured to collect a foreign substance; and a suction nozzle apparatus having a suction passage coupled to the main body, wherein the suction nozzle apparatus includes:

a drum brush including a foreign substance collecting groove configured to collect the foreign substance and a plurality of rubber blades coupled in a spiral form to move the foreign substance to the foreign substance collecting groove; and a cutting member fixed in a position corresponding to the foreign substance collecting groove, and configured to remove the foreign substance from the foreign substance collecting groove through at least one of cutting or heating.

* * * * *